United States Patent [19]

Yamashita et al.

[11] 4,263,390

[45] Apr. 21, 1981

[54] RESIDUAL TONER REMOVING DEVICE

[75] Inventors: Keitaro Yamashita, Kamisato; Ryuji Goto, Kumagaya, both of Japan

[73] Assignee: Hitachi Metals, Ltd, Chiyoda, Japan

[21] Appl. No.: 5,213

[22] Filed: Jan. 22, 1979

[30] Foreign Application Priority Data

Jan. 24, 1978 [JP] Japan ..... 53/6547

[51] Int. Cl.[3] ..... B05C 11/10

[52] U.S. Cl. ..... 430/125; 15/256.52; 118/652; 118/639; 355/15

[58] Field of Search ..... 427/21, 18, 47; 118/652, 639, 656; 355/15; 15/256.52; 346/74.1; 430/39, 125

[56] References Cited

U.S. PATENT DOCUMENTS

| | | | |
|---|---|---|---|
| 3,333,572 | 8/1967 | Olden | 118/656 |
| 3,632,370 | 1/1972 | Weiler | 427/21 |
| 3,807,853 | 4/1974 | Hudson | 355/15 |
| 3,848,994 | 11/1974 | Fraser | 355/15 |
| 3,918,808 | 11/1975 | Narita | 118/657 X |
| 4,097,140 | 6/1978 | Suzuki et al. | 355/15 |
| 4,161,738 | 7/1979 | Kokaji | 346/74.1 |

FOREIGN PATENT DOCUMENTS 52-86337 7/1977 Japan .

*Primary Examiner*—Shrive P. Beck

*Attorney, Agent, or Firm*—Finnegan, Henderson, Farabow, Garrett & Dunner

[57] ABSTRACT

A device for removing residual toner from the surface of a photoreceptor after the transfer of a toner image from the photoreceptor surface to another surface comprises a fur brush for lightly sweeping residual toner particles on the surface of the photoreceptor to align the particles substantially in streaks along the sweeping direction and a magnetic roll for picking up the aligned toner particles by the magnetic attraction force of the magnetic roll. The fur brush is positioned adjacent to, and in a slight contact with, the surface of the photoreceptor. The magnetic roll is disposed adjacent to the surface of the photoreceptor and at the trailing side of the fur brush along the path of relative movement with the photoreceptor.

11 Claims, 1 Drawing Figure

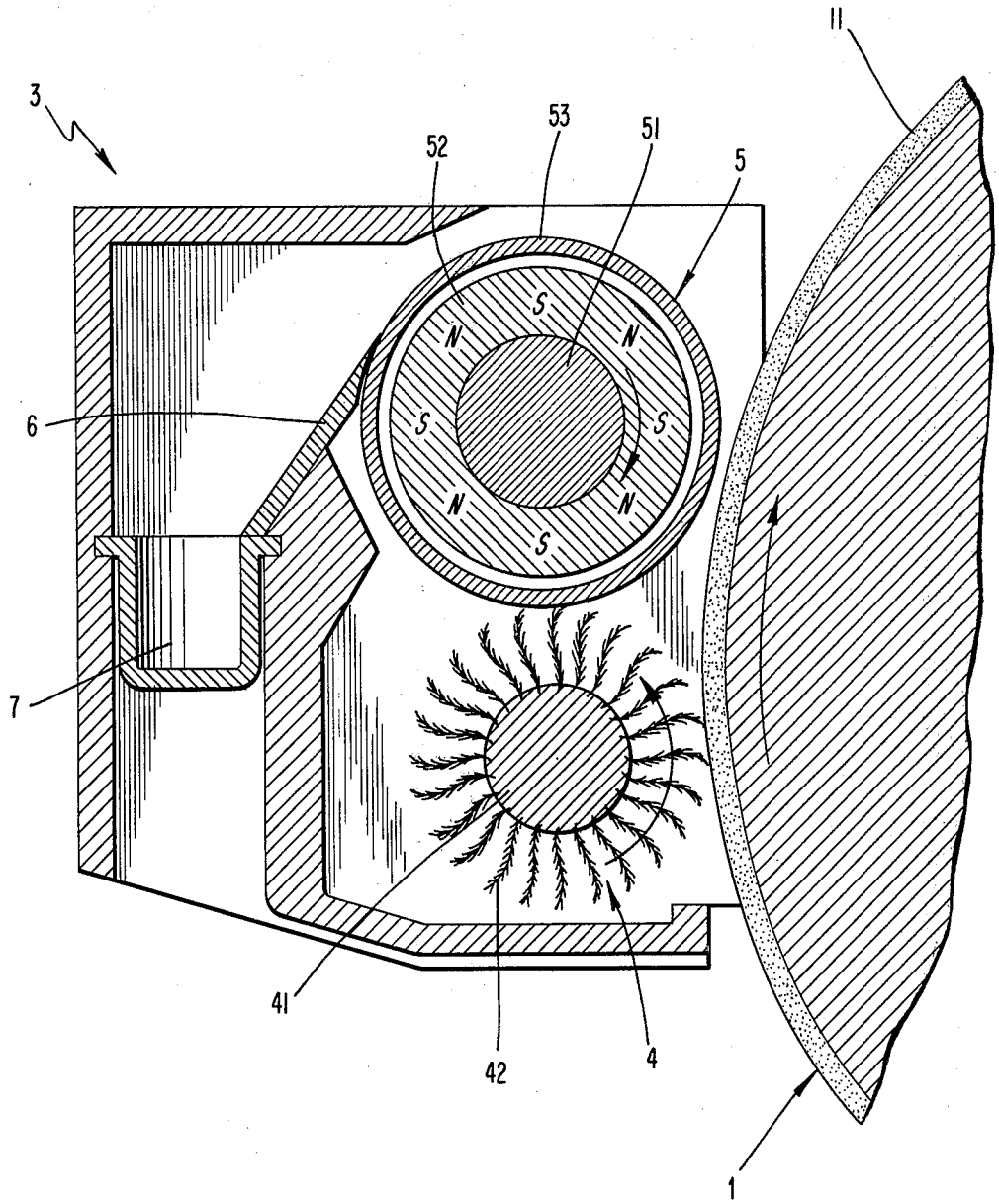
3
52
53
51
5
11
6
7
41
42
4
1
N
S
N
S
S
N
N
S

RESIDUAL TONER REMOVING DEVICE

BACKGROUND OF THE INVENTION

This invention relates to a cleaning device for a photoelectric receptor, particularly to a device for removing residual magnetic toner particles left on the photoelectric sheet after a toner image has been transferred from the photoelectric sheet to another sheet such as plain paper and to a process for such removal of toner particles.

A customary photoelectric duplicating process includes: uniformly charging the surface of a photoreceptor by a corona charger or the like; exposing the charged surface to a light image which is to be duplicated; adhering toner particles to the surface to make a toner image; and transferring the toner image to another sheet. In order to repeat this process, it is necessary to remove the residual toner left on the photoreceptor after the transfer step. Various cleaning means and methods have been developed previously.

A typical cleaning process is that the residual toner is scraped off by a rubber blade. But, in this process the photosensitive surface of the photoreceptor tends to be scratched by the scraping.

Another typical cleaning method includes the use of a fur brush which has animal fur attached to a rotatable shaft in such a manner that the tips of the fur form a cylinder. In order to remove completely the residual toner by the fur brush, the fur brush contacts the surface of the photoreceptor with a certain strength. This strong contact causes damage to the photoreceptor and the fur brush, so that it is necessary to renew them frequently. Furthermore, in the latter process, it is necessary to gather the removed toner by suction after removing the toner from the photoreceptor. Instead of gathering excess toner by suction, Suzuki et al, Japanese laid open patent publication No. 52-13343 published Feb. 1, 1977, proposed a cleaning method that, after removing the residual toner by a fur brush, the toner adhered on the fur brush is removed by a magnetic roll and subsequently the toner on the magnetic roll is gathered by a scraper blade.

Cleaning methods using a magnetic brush have been proposed to eliminate drawbacks in the use of the fur brush. For example, Ohnuma et al, Japanese laid open patent publication No. 52-86337 published July 18, 1977, discloses that residual one-component magnetic toner left on a photoreceptor can be removed by a magnetic brush formed on a magnetic roll which is similar to one which is used to develop a latent image. To remove residual magnetic toner by the magnetic brush, a certain amount of magnetic toner is adhered on a magnetic roll to form the magnetic brush of the toner and the magnetic brush sweeps the residual toner left on a photoreceptor to adhere the residual toner to the magnetic brush. Such magnetic brushing methods have an advantage that residual toner can be removed with an extremely soft contact with the surface of a photoreceptor and the possibility of scratching the photoreceptor is eliminated. However, a certain amount of toner usually contacts the surface of the photoreceptor so that the toner tends to agglomerate or to form cakes. In addition, the direct contact between the magnetic brush and the photoreceptor is disadvantageous because the life of the photoreceptor, especially the surface of zinc oxide-coated paper, is adversely affected by the continued contact.

The term "magnetic roll" or "magnet roll" is well known by those of ordinary skill in the art. The constructions of magnetic rolls are disclosed, for example, in Yamashita et al U.S. Pat. No. 3,828,730 and Anderson U.S. Pat. No. 3,455,276. It is not necessary to explain developing processes using one-component magnetic toner, since the various processes are shown, for example, in Kotz U.S. Pat. No. 3,909,258 and Nishihama et al U.S. Pat. No. 4,081,571.

SUMMARY OF THE INVENTION

It is therefore a principal object of the invention to improve apparatus and methods for removing residual toner from a photoreceptor surface.

It is a further object of the invention to reduce the adverse effect of a residual toner removing device on the surface of the photoreceptor, such as zinc oxide-coated paper.

It is a still further object of the invention to remove residual one-component toner from the surface of a photoreceptor with excellent performance.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the device for removing residual toner from the surface of a photoreceptor of the invention comprises a fur brush for lightly sweeping residual toner particles on the surface of the photoreceptor to align the toner particles substantially in streaks along the sweeping direction and a magnetic roll for removing the aligned toner particles from the surface of the photoreceptor by magnetic attraction.

The fur brush is positioned adjacent to and in a slight contact with the surface of the photoreceptor. The magnetic roll is disposed adjacent the surface of the photoreceptor and at the trailing side of the fur brush along the path of relative movement of the photoreceptor and the fur brush and magnetic roll.

The magnetic roll may comprise a shaft, a permanent magnetic member positioned around the shaft and a cylindrical, nonmagnetic shell surrounding the permanent magnet member. The permanent magnetic member may be formed as a cylindrical column disposed coaxially to the shaft. The magnet may have a plurality of axially elongated magnetic poles on the surface. The peak value of the magnetic field of the permanent magnet should be at least 270 gauss, preferably at least 440 gauss, at the photoreceptor surface opposite to the magnetic roll. The permanent magnet member may rotate relatively to the cylindrical nonmagnetic shell. It is preferable that the magnet rotates and the cylindrical shell is stationary. The fur brush may be in contact with the shell surface of the magnetic roll.

Furthermore, the invention includes a process for removing residual toner from the surface of the photoreceptor comprising: lightly sweeping the residual magnetic toner on the surface of the photoreceptor by a fur brush to form chains of the toner on the surface along a direction of the relative movement between the surface and the fur brush; subjecting the toner chains on the surface to a magnetic field exterior with the photoreceptor; and moving the magnetic field away from the surface to remove the toner chains from the surface.

BRIEF DESCRIPTION OF THE DRAWING

The present invention will be described in detail with reference to the accompanying drawing, in which the single FIGURE shows a schematic sectional view of a residual toner-removing device according to the present invention.

DETAILED DESCRIPTION OF THE PREFERRED EMBODIMENT

The preferred embodiment of the device of the invention for removing residual toner from a photoreceptor surface is shown in the FIGURE in which a photoreceptor layer 11 is conventionally disposed on the curved surface of a drum, numbered generally as 1, which drum rotates clockwise, for example around its axis. As the photoreceptor layer 11, a photoconductive layer may be used, such as an amorphous selenium deposited on an aluminum substrate, a polyester film overlying a layer of photoconductive cadmium sulfide disposed in an insulating binder, a layer of photoconductive zinc oxide disposed in an insulating binder or the like, as well-known. The duplicating machine itself will include a number of structures such as corona charger, an optical system for exposing the photoreceptor to a light image to be duplicated, a developing unit for developing the latent image, and means for transferring the developed toner image to another sheet, not shown, around the photoreceptor drum 1, as is customary.

A residual toner-removing device according to the present invention, generally shown by numeral 3, comprises a fur brush 4 and a magnet roll 5 both adjacent the surface of photoreceptor 11. The fur brush 4 has a rotation shaft 41 and fur 42 attached to the shaft. Preferably, the fur is animal fur, but napped synthetic cloth may be used.

The tips of the fur form a cylinder and slightly contact the photoreceptor surface 11 at the opposed portion of the drum 1. Preferably, the fur brush 4 has a direction of rotation opposite to the rotation of the photoreceptor drum 1, so-called in "with-mode", so that the tips of the fur brush lightly sweep the surface of the photoreceptor without the scattering of the toner.

For purposes of referring to relative motion between curved surfaces, hereinafter the terms "with-mode" and "against-mode" will be used as known in the art. When two rolls are rotating in opposite directions, adjacent curved surfaces of the rolls move in the same direction. This condition is customarily referred to as "with-mode." By contrast, when the directions of rotation of the rolls are the same, the adjacent curved surfaces move in opposite directions, referred to as "against-mode."

The magnet roll 5 is positioned in spaced relation to the path of movement of the surface of the photoreceptor 11 and at the trailing side of the fur brush 4. The magnet roll 5 comprises a shaft 51, a cylindrical magnet 52 secured on the shaft 51 and a nonmagnetic cylindrical shell 53 of plastic, aluminum or stainless steel. The nonmagnetic cylindrical shell 53 is held by bearing-mounted end caps (not shown) on each end of the shell and there is relative movement between the cylindrical magnet 52 and the shell. The magnet 52 has a plurality of magnetic poles on the curved surface of the magnet extending along the shaft 51 and the adjacent magnetic poles have opposite magnetic polarities as known in the art.

It is preferable that the cylindrical magnet 52 rotates and the cylindrical shell 53 is stationary. When the magnet 52 rotates clockwise as shown in the drawing, that is, it moves in the opposite direction to the movement of the photoreceptor 11 at the opposing portion, i.e., in the against-mode, the toner is carried along the surface of the shell 53 in the opposite direction to the rotation of the magnet 52, that is, the carried direction is the same as the movement of the surface of the photoreceptor 11, i.e., in with-mode. Such a rotation of the magnet 52 results in the effective picking up of the toner from the surface of the photoreceptor 11. The rotation speed of the magnet preferably is 250 to 500 r.p.m.

As the cylindrical magnet 52, an isotropic or anisotropic ferrite magnet, such as Ba-ferrite, Ba-Sr-ferrite or Sr-ferrite, may be used which produces a magnetic flux density of 700 to 1200 gauss on the shell 53. Since the cylindrical magnet has its adjacent magnetic poles with opposite polarities along the peripheral surface of the magnet, the component of the magnetic flux density normal to the surface shows a sine curve distribution along the peripheral line and has its peak values on the poles. The magnetic poles face the photoreceptor surface in succession according to rotation of the magnet. The normal component of the magnetic flux density at the photoreceptor surface should be at least 270 gauss in its peak value and is preferably at least 440 gauss in order to remove the residual toner from the photoreceptor.

Further, a scraper blade 6 is fixed adjacent the shell 53 of the magnet roll to remove the toner moving along the shell and to collect it in a reservoir 7. As stated previously, the shell is preferably stationary. In this case the scraper blade can be attached to or integral with the shell. The toner particles moving along the shell, under the force of the rotating magnet just slide down the scraper blade 6 under gravity into the reservoir 7.

Toner, which is left on the photoreceptor 11 after a transfer step, is swept lightly by rotation of the fur brush, as stated above. By the sweeping, a small part of the toner may adhere to the tips of the fur brush 4, but most of the toner remains on the photoreceptor 11 and aligns in streaks on the surface along the direction of the with-mode relative movement between the surface and the fur brush.

The toner particles aligned in streak form are either closely in contact in lines or closely spaced in lines, so that they are in a configuration tending to form chains under the magnetic field of the magnet roll 5 and in a state more susceptible to magnetic attraction than in their previous randomly arranged state. When the toner is conveyed by the rotation of the photoreceptor 11 to the position at which the toner is subjected to enough of the magnetic field of the magnet roll 5, the toner is removed from the photoreceptor 11 to the shell 53 of the magnet roll.

In the case in which the magnet 52 rotates clockwise and the shell 53 is stationary, as shown in the drawing, the picked-up toner particles are carried counterclockwise along and on the shell surface. Subsequently, the toner particles on the shell 53 are scraped by the blade 6 away from the shell 53 into the toner reservoir box 7. When the shell 53 is stationary, as preferred, there is no relative movement between the shell 53 and the scraper blade 6, so that no possible scratch on the shell 53 occurs.

As shown in the preferred embodiment, the fur brush 4 contacts slightly the shell surface 53 of the magnet roll. The toner adhered to the tips of the fur brush 4 is thereby removed by the contact with the magnet roll 5, so that the fur brush 4 is kept clean. Experiment 1:

The cleaning efficiency of the residual toner-removing device of the invention was measured, using zinc oxide-coated paper as a photoreceptor mounted on a rotating drum, a polyester fur brush (30 mm diameter, 300 r.p.m.), rotating oppositely to the drum, a magnet roll (31.4 mm diameter, 300 r.p.m., 8 poles, magnetic flux density on the shell surface: 800 gauss) and one-component magnetic toner.

The zinc oxide-coated paper was uniformly charged negatively and was developed by the one-component magnetic toner to obtain a uniform black toner image. In a series of four tests, the black toner images on the zinc oxide-coated paper were removed by residual toner-removing devices with the magnet rotating or with the shell rotating, after sweeping by the fur brush, and without sweeping. The results of the experiments are shown in Table 1.

TABLE 1

| | Cleaning Effects | |
|---|---|---|
| | After sweeping | Without sweeping |
| Rotating shell | The image partially remained | The image remained |
| Rotating magnet | The paper was completely cleaned | The image partially remained |

It is obvious from Table 1 that the swept toner is removed more easily by the magnet roll than unswept toner. And also, the rotating magnet-type magnet roll has better efficiency than the rotating shell-type magnet roll. Experiment 2:

The residual toner-removing device was assembled with the parts and materials as described in Experiment 1. Zinc oxide-coated paper was set on the peripheral surface of the drum and one-component magnetic toner was deposited uniformly on the zinc oxide-coated paper. For the purpose of this experiment, the drum was stationary and after being swept by the fur brush, the toner was removed by the magnet roll which was set facing the same portion of the zinc oxide-coated paper that the fur brush swept. Variation of the magnetic field on the zinc oxide-coated paper was obtained by changing the distance between the magnet roll and the paper.

Table 2 shows the relationship of the cleaning widths with the magnetic flux densities on the zinc oxide-coated paper created by the magnet roll. The cleaning width is defined as the width of cleaned band which was made on the previously swept stationary zinc oxide-coated paper by the magnet roll at various distances with resultant differing magnetic flux densities.

TABLE 2

| Magnetic flux density | Cleaning width |
|---|---|
| 100 gauss | 0 mm |
| 270 | 12 |
| 440 | 21 |
| 560 | 24 |
| 660 | 28 |
| 860 | 29 |
| 940 | 30 |

Since the cleaning width corresponds to the width of the area that is cleaned at one pass by the device of the present invention, it is desirable that the cleaning width be as wide as practicable. But, in a practical machine, the drum rotates relatively to both the magnet roll and the fur brush, so that the cleaned bands appear successively or overlappingly on the zinc oxide-coated paper to clean the whole surface. According to the inventors' observation, a cleaning width of more than 12 mm was sufficient and when the width was more than 20 mm, the residual toner could not be observed. It follows that a magnetic strength on the photoreceptor of at least 270 gauss is desired. It is preferable that the magnetic strength is at least 440 gauss.

It will be apparent to those skilled in the art that the cleaning device of this invention is effective to remove the residual toner on the photoreceptor surface after a transfer step without strong contact to the photoreceptor or occurrence of damage or scratch.

What is claimed is:

1. A device for removing residual magnetic toner remaining on the surface of a photoreceptor, the device comprising:

means for only aligning the residual toner on the photoreceptor substantially in streaks during relative movement between the photoreceptor and the aligning means, said aligning means being positioned adjacent the photoreceptor surface; and means for magnetically attracting the aligned toner to remove the aligned toner from the surface of the photoreceptor, said attracting means being positioned adjacent the photoreceptor surface, wherein the photoreceptor is rotating and wherein the aligning means includes a rotatable fur brush in an at least slight contact relation with the surface of the photoreceptor;

wherein the magnetically attracting means includes a magnet roll having a shaft, a permanent magnet member positioned around the shaft, the permanent magnet member having a plurality of axially elongated magnetic poles on the surface, and a cylindrical nonmagnetic shell surrounding the permanent magnet member and being relatively rotatable to the permanent magnet member, the magnet roll being positioned in a spaced relation to the surface of the photoreceptor; and wherein the device further includes a scraper blade adjacent the surface of the shell for scraping attracted toner off the magnet roll.

2. The residual toner-removing device as set forth in claim 1, wherein the permanent magnet member of the magnet roll rotates and the shell is stationary.

3. The residual toner-removing device as set forth in claim 2, wherein the permanent magnet member rotates in a direction for carrying toner along the surface of the shell in a direction with the movement of the photoreceptor surface.

4. The residual toner-removing device as set forth in claim 3, wherein the magnetic field due to the permanent magnet member shows a peak value of at least 270 gauss at the photoreceptor surface.

5. The residual toner-removing device as set forth in claim 4, wherein the magnetic field due to the permanent magnet member shows a peak value of at least 440 gauss at the photoreceptor surface.

6. A device for removing residual magnetic toner remaining on the surface of a photoreceptor, the device comprising:

means for only aligning the residual toner on the photoreceptor substantially in streaks during relative movement between the photoreceptor and the aligning means, said aligning means being positioned adjacent the photoreceptor surface; and means for magnetically attracting the aligned toner to remove the aligned toner from the surface of the photoreceptor, said attracting means being positioned adjacent the photoreceptor surface, wherein the photoreceptor is rotating and wherein the aligning means includes a rotatable fur brush in an at least slight contact relation with the surface of the photoreceptor;

wherein the magnetically attracting means includes a magnet roll having a shaft, a permanent magnet member positioned around the shaft, the permanent magnet member having a plurality of axially elongated magnetic poles on the surface, and a cylindrical nonmagnetic shell surrounding the permanent magnet member and being relatively rotatable to the permanent magnet member, the magnet roll being positioned in a spaced relation to the surface of the photoreceptor;

wherein the permanent magnet member of the magnet roll rotates and the shell is stationary;

wherein the permanent magnet member rotates in a direction for carrying toner along the surface of the shell in a direction with the movement of the photoreceptor surface; and wherein the fur brush is in a contact relation with the shell surface of the magnet roll and the magnet roll is positioned at the trailing side of the fur brush along the path of the movement of the photoreceptor.

7. The residual toner-removing device as set forth in claim 6, wherein the fur brush comprises a rotatable shaft and animal fur attached to the shaft.

8. The residual toner-removing device as set forth in claim 6, wherein the fur brush comprises a rotatable shaft and napped synthetic cloth attached to the shaft.

9. The residual toner-removing device as set forth in claim 1 or 6 wherein said fur brush is rotating in a direction with the movement of said photoreceptor surface.

10. A residual toner-removing device for removing from the surface of a photoreceptor the residue of magnetic toner left thereon after a step of transferring the magnetic toner image from the surface of the photoreceptor to another surface, the device comprising:

a rotatable fur brush disposed adjacent the surface of the photoreceptor, the periphery of the brush being in slight contact relation with the surface of the photoreceptor and rotating in with-mode with the movement of the surface, a magnet roll having a rotatable shaft, a cylindrical permanent magnet secured around the shaft, the permanent magnet having a plurality of axially elongated magnetic poles on the peripheral surface of the magnet, and a stationary cylindrical nonmagnetic shell surrounding the permanent magnet, the magnet roll being disposed at the trailing side of the fur brush along the path of the movement of the photoreceptor and being in contact relation with the fur brush and in a spaced relation with the surface of the photoreceptor for providing a magnetic field on the photoreceptor for the peak value of at least 440 gauss, and a scraper blade in contact with the shell surface for scraping the attracted magnetic toner off the shell.

11. A process for removing residual toner from the surface of a photoreceptor after transfer of a developed magnetic image from the receptor, the process comprising:

sweeping the residual magnetic toner on the surface by a fur brush to form chains of the toner aligned on the surface along the direction of the relative movement between the surface and the fur brush, substantially all the residual toner remaining on the photoreceptor surface following said sweeping step, subjecting the toner chains on the surface to an attractive magnetic field, and moving the magnetic field away from the surface to remove the toner chains from the surface.

* * * * *